United States Patent [19]

Zosel

[11] 3,969,382

[45] July 13, 1976

[54] PROCESS FOR THE SIMULTANEOUS HYDROGENATION AND DEODORISATION OF FATS AND/OR OILS

[75] Inventor: Kurt Zosel, Oberhausen, Germany

[73] Assignee: Studiengesellschaft Kohle m.b.H., Mulheim, Germany

[22] Filed: Aug. 29, 1974

[21] Appl. No.: 501,733

[30] Foreign Application Priority Data

Aug. 30, 1973 Austria ..... 7525/73

[52] U.S. Cl. ..... 260/409; 260/420; 260/428

[51] Int. Cl.[2] ..... C11C 3/12

[58] Field of Search ..... 260/409, 420, 428

[56] References Cited

UNITED STATES PATENTS

| | | | |
|---|---|---|---|
| 2,282,791 | 5/1942 | Murher | 260/428 |
| 2,292,027 | 8/1942 | Glenn | 260/409 |
| 2,359,404 | 10/1944 | Colgate | 260/409 |
| 2,521,602 | 9/1950 | Potts et al. | 260/409 |
| 2,773,081 | 12/1956 | Brown | 260/409 |
| 3,758,532 | 9/1973 | Gibble | 260/420 |

FOREIGN PATENTS OR APPLICATIONS

| | | | |
|---|---|---|---|
| 1,057,911 | 4/1964 | United Kingdom | 409/ |

*Primary Examiner*—Patrick P. Garvin
*Assistant Examiner*—John F. Niebling
*Attorney, Agent, or Firm*—Burgess, Dinklage & Sprung

[57] ABSTRACT

Process for the simultaneous hydrogenation and deodorisation of at least one product from the group consisting of fats and oils, wherein said product is treated with carbon dioxide at a temperature of from 100° to 250°C and a pressure of from 150 to 300 atmospheres in the presence of a hydrogenation catalyst, and hydrogen.

The fats and oils hydrogenated and deodorised in this process are used in the manufacture of margarine.

22 Claims, 3 Drawing Figures

PROCESS FOR THE SIMULTANEOUS HYDROGENATION AND DEODORISATION OF FATS AND/OR OILS

Figure 1:
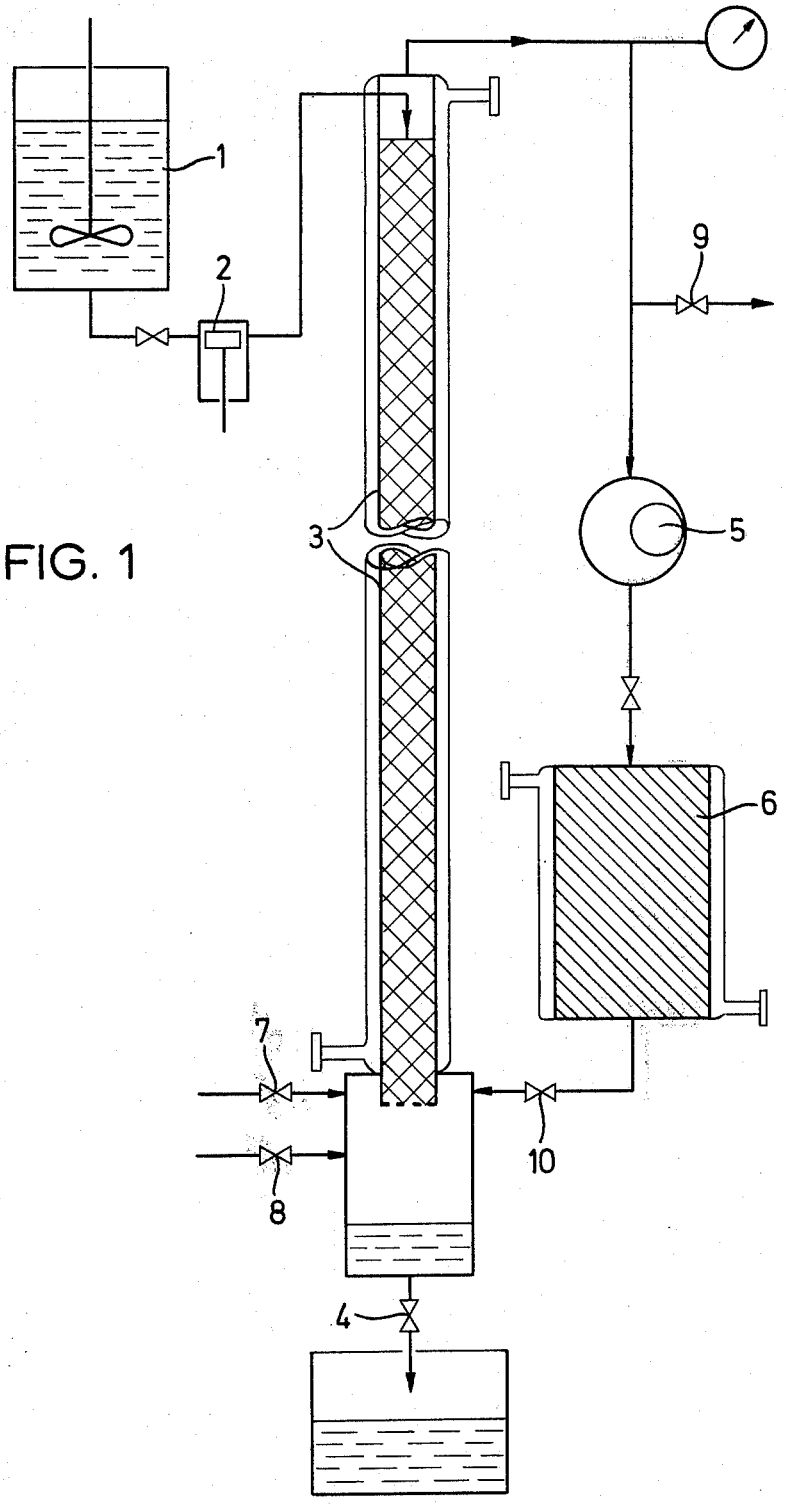

This invention relates to a process for the simultaneous hydrogenation and deodorisation of fats and/or oils.

Both vegetable and animal fats and oils are used in the manufacture of margarine. Natural fats and oils do not satisfy the very high standards of quality demanded of starting materials used for the manufacture of margarine.

The fats and oils must therefore be carefully refined in a multistage process before they are processed. The last stage of this refining process is generally that of deodorisation and is the most expensive. Even the best table oil cannot be used as starting material for the manufacture of margarine because of its taste of seed but oils used for the manufacture of margarine need not be resistant to low temperatures and may have a certain colour of their own.

Furthermore, the melting point of the fats and oils must be neither too high nor too low. If the substance has a melting point above body temperature, it is less easily digestible and, if its melting point is very low it cannot be used directly as a component of margarine because margarine must have a quite specific consistency, that is to say it must be firm enough to be cut and yet spreadable.

Many vegetable and animal fats and oils therefore not only require careful refining before they are used as starting material for margarine but also must be chemically altered, i.e. partially hydrogenated or hardened. The hardening (hydrogenation) of oil is basically a process of addition of hydrogen atoms to one or more double bonds of the fatty acid chain (Ullmann, Encyklopadie der technischen Chemie, 3rd Edition, 1956, Volume 7, pages 529 et seq (published by Urban & Schwarzenberg, Munich-Berlin)).

The oils are not completely hydrogenated but only until the melting point has risen to about 28° to 38°C. The iodine number falls correspondingly. Catalysts are necessary for hardening. Finely divided nickel is nowadays the most commonly used catalyst. The catalyst, the oil which is to be hardened and hydrogen must be brought into intimate contact with each other under suitable temperature and pressure conditions. A temperature of 160° to 200°C, a hydrogen pressure of 1 to 5 atmospheres and 0.01 to 0.2% by weight, based on the oil of active nickel as catalyst are generally employed. Thorough mixing of the hydrogen, oil and catalyst are essential for economical hardening.

Since hardening increases the acid number of oils, the hardening of edible fats is generally followed by a treatment with alkaline liquor before the fat is deodorised. For the manufacture of edible fats the deodorisation of the hardened materials is essential because hardening produces a characteristic hardening odour and flavour which are due to the formation of higher aldehydes and alcohols.

In the U.S. Pat. application Ser. No. 369,689 a process is described for the deodorisation of fats and oils, optionally with simultaneous reduction of the residual free fatty acid content, in which the material which is to be purified is treated with carbon dioxide at a temperature of from 50° to 250°C and a pressure of 100 to 250 atmospheres, preferably under countercurrent conditions.

The treatment of fats or oils with carbon dioxide is preferably carried out under countercurrent conditions. This can easily be achieved in a column, for example a packed column by introducing the starting material which is to be purified into the top of the column while carbon dioxide sweeps upwards from the bottom of the column. The stream of carbon dioxide leaving the top of the column carries the unwanted impurities with it.

The carbon dioxide preferably flows in a cycle. At least part of the impurities absorbed are removed from the carbon dioxide stream before the latter is returned to the exchange column together with the starting material which is to be purified. Removal of these unwanted impurities can be carried out in known manner by subjecting the carbon dioxide to below critical conditions or by lowering the pressure and/or raising the temperature in the above-critical range.

It has been found, however, that the removal of absorbed impurities from the stream of carbon dioxide which is under above critical conditions can be achieved also by passing the stream of carbon dioxide charged with impurities through an adsorbent, preferably a solid adsorbent, for example active charcoal. Although the purification of streams of gas at below critical conditions by means of solid adsorbents is already known, it was not foreseeable how such adsorbents would behave in the presence of contaminated streams of gas under above-critical conditions.

It has surprisingly been found that simply treating the stream of carbon dioxide laden with impurities with a solid adsorbent is sufficient to ensure that the carbon dioxide will be suitable for reuse at the deodorisation stage. Substantial changes in pressure and/or temperature before or during the treatment with adsorbent are not necessary. A particularly simple and cost saving circulating process therefore becomes possible in which the stream of carbon dioxide kept under the specified pressure and temperature conditions is first brought into contact with the impure fats or oils, preferably in countercurrent, whereupon the stream of carbon dioxide now laden with unwanted impurities is passed over an adsorbent. This adsorbent is replaced by fresh adsorbent when its purifying power for the stream of impure carbon dioxide falls too low.

This process is particularly important for the purification of fats and oils of natural, in particular vegetable and/or animal, origin but may also be used for oils and fats produced synthetically.

An object of the present invention is a process for the simultaneous hydrogenation and deodorisation of fats and/or oils in which the product which is to be treated is treated with carbon dioxide, preferably under countercurrent conditions, at a temperature of from 100° to 250°C and a pressure of from 150 to 300 atmospheres in the presence of a hydrogenation catalyst, and hydrogen is added to the carbon dioxide throughout the process. It is immaterial whether the hydrogen is added stepwise or continuously provided only that sufficient hydrogen is available for hydrogenation. The hydrogen partial pressure is preferably in the region of from 1 to 10 atmospheres. A particularly suitable metal hydrogenation catalyst is nickel, preferably present in a quantity of 0.01 to 0.2% by weight based on the quantity of starting material to be treated.

The comments made above with reference to U.S. Pat. application Ser. No. 369,689 apply also to the process according to the invention. As regards hydrogenation, the process according to the invention is based on the known art, as described in Ullmann, Encyklopadie der technischen Chemie, referred to above.

The process will now be explained more fully in the following examples with reference to the accompanying drawings.

Figure 2:
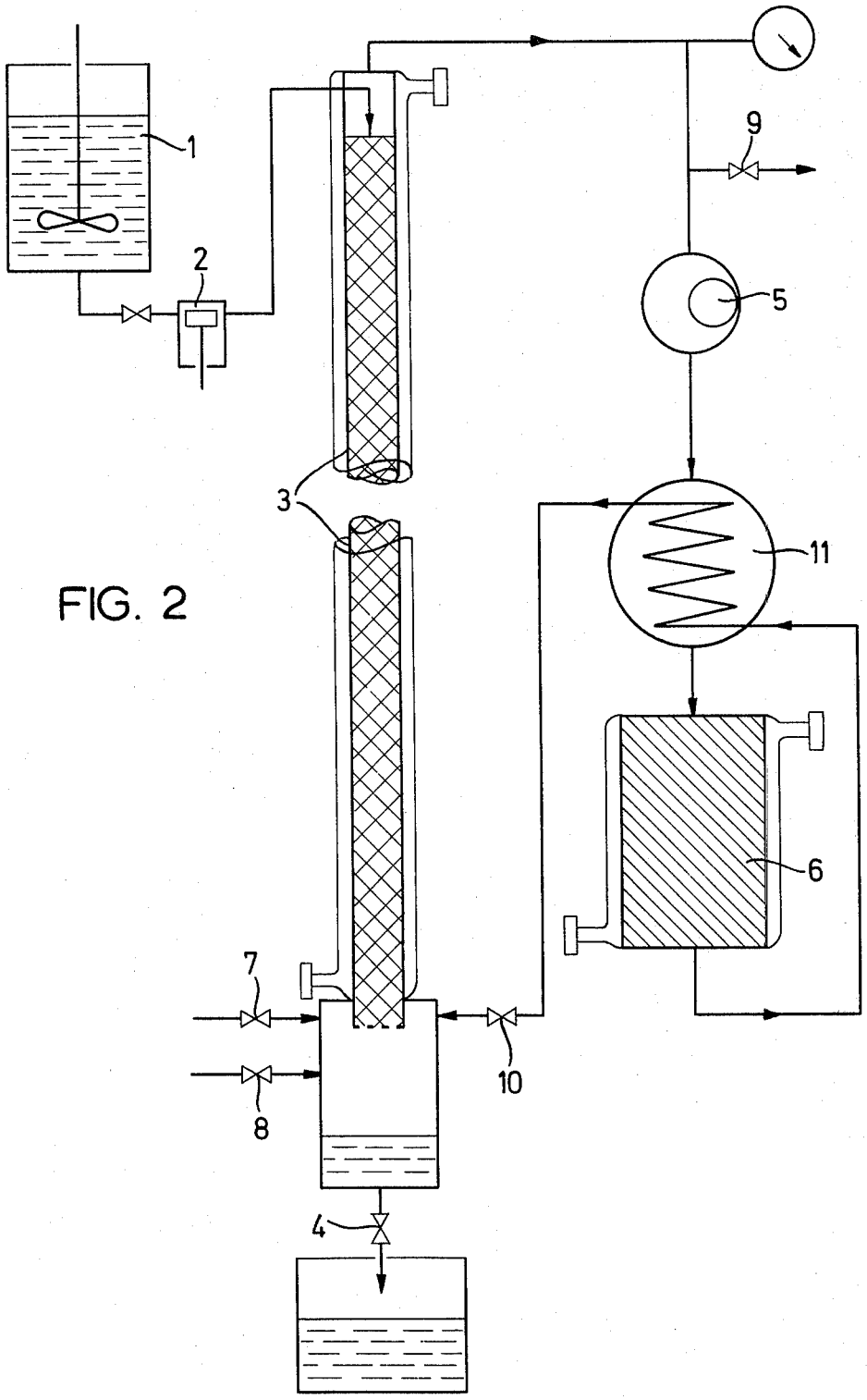
Figure 3:
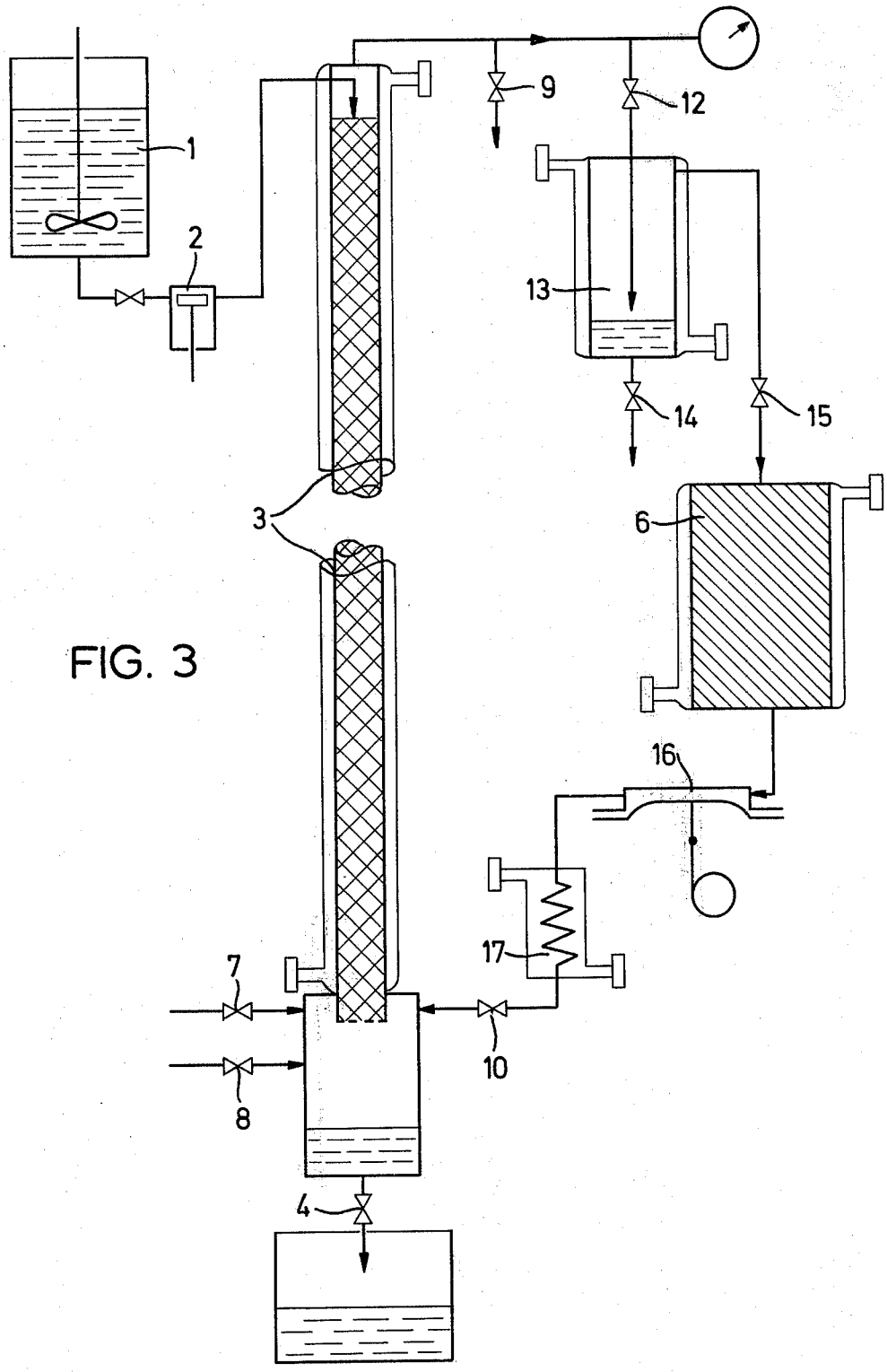

FIGS. 1, 2 and 3 show different embodiments of apparatus in which the process according to the invention may be carried out.

EXAMPLE 1

(carried out in the apparatus of FIG. 1)

The storage container 1 was charged with ground nut oil (saponification number 191, idoine number 96, melting point −2°C, free fatty acid content 0.6%) to which 0.1% of finely divided nickel had been added. The oil was fed continuously into the top of a column 3 which was 15 m in height from the storage container 1 by means of the injection pump 2. The column had an internal width of about 6 cm, was filled with glass balls and widened at its lower end. The column was heated to 190°C by means of a heating jacket welded to the outside. The oil flowed over the glass balls to the bottom of the column and was continuously discharged through the valve 4.

At the same time, carbon dioxide was circulated upwards through the column from the base by way of the circulating blower 5 and separator 6 at a pressure of 200 atmospheres. The separator 6, which also had a heating jacket welded to it, was heated to 190°C and filled with solid adsorbent, in this case active charcoal.

Before the oil was fed into the column, the apparatus was filled with carbon dioxide from the inlet valve 7. Slight losses of carbon dioxide were also made good through the same valve during operation. Hydrogen was constantly supplied through valve 8 at such a rate that the circulating carbon dioxide had a hydrogen partial pressure of 1.5 atmospheres. The level of hydrogen in the circulating carbon dioxide was controlled by gas analysis by taking samples of the circulating gas from the valve 9. If desired, the hydrogen may be introduced in the middle or lower third of column 3 instead of into the bottom of the column through valve 8. Approximately 4 kg of oil per hour were fed continuously into the top of the column.

The ground nut oil discharged at valve 4 was odourless and flavourless after it had been passed through a filter press to remove finely divided nickel, and it had a free fatty acid content of 0.02%, an iodine number of 66 and a melting point of 34°C.

EXAMPLE 2

The apparatus shown in FIG. 2 was used. It was substantially similar to the apparatus in FIG. 1 but column 3 and separator 6 were not kept at the same temperature. Column 3 was heated to 200°C and the separator to 80°C. The advantage of this method was that the active charcoal in the separator 6 can be more heavily charged with foreign substances (substances with an undesirable odour or flavour and free fatty acids). A heat exchanger 11 was in this case advisable to improve the thermal equilibrium.

A sunflower oil (saponification number 193, iodine number 131, melting point −15°C, free fatty acid content 0.8%) was used in this case and 0.1% of finely divided nickel was added.

Carbon dioxide pressure 220 atmospheres,
temperature in column 3: 200°C,
temperature in separator 6: 80°C,
hydrogen partial pressure at head of column: 2 atmospheres.

5 kg of oil were fed in per hour. The product discharged at valve 4 had the following characteristics: Free fatty acid content 0.015%, iodine number 65, melting point 32°C, and it was odourless and flavourless.

EXAMPLE 3

The apparatus of FIG. 3 was used. In the apparatus shown in FIG. 1, the circulating carbon dioxide to which small quantities of hydrogen had been added was passed at practically constant pressure and constant temperature through column 3 and separator 6, which contained the active charcoal.

In the apparatus shown in FIG. 2, the circulating carbon dioxide to which small quantities of hydrogen had been added was passed through column 3 and separator 6 at practically constant pressure but varying temperatures.

In the apparatus shown in FIG. 3, the circulating carbon dioxide to which small quantities of hydrogen had been added was passed through column 3 and separator 6 at varying pressures and varying temperatures.

The pressure of the circulating carbon dioxide was reduced to about 70 atmospheres in the pressure relief valve 12, that is to say to slightly below the critical pressure of carbon dioxide, and the carbon dioxide was then introduced into the intermediate separator 13. By far the major portion of the impurities removed from the oil was precipitated by the pressure drop and collected at the bottom of the intermediate separator 13 from which is could then be removed through valve 14.

The gas flowed from the intermediate separator 13 into the separator 6 which also was charged with active charcoal. From there, the gas entered the compressor 16 where it was recompressed to the operating pressure in column 3 and it was then reheated to the temperature of column 3 in the heating apparatus 17 and then passed through valve 10 to be recycled.

The intermediate separator 13 and separator 6 were heated to about 80°C and column 3 and heating apparatus 17 to 210°C. The carbon dioxide pressure in column 3 was 235 atmospheres, the hydrogen partial pressure at the top of column 3 was about 3 atmospheres. Column 3 was charged with 5 kg/hour of whale oil (saponification number 196, iodine number 126, free fatty acid 0.9%) to which 0.08% of finely divided nickel had been added.

The product discharged through valve 4 was odourless and flavourless and had an iodine number of 63, a melting point of 33°C and a residual free fatty acid content of 0.03%.

Fish oil, cottonseed oil, rape oil and soya oil can be hardened and deodorised in the same manner.

I claim:

1. A process for the simultaneous hydrogenation and deodorisation of at least one product from the group consisting of fats and oils, wherein said product is contacted with carbon dioxide in an amount effective for the deodorisaton and containing hydrogen in an amount effective for the hydrogenation, at a temperature of from 100° to 250°C and a pressure of from 150 to 300 atmospheres in the presence of a catalyst for the hydrogenation.

2. A process according to claim 1 wherein said contacting is carried out countercurrently.

3. A process according to claim 1 wherein said hydrogen is added to said carbon dioxide stepwise during said process.

4. A process according to claim 1 wherein said hydrogen is added to said carbon dioxide continuously during said process.

5. A process according to claim 1 wherein the partial pressure of said hydrogen in said carbon dioxide is from 1 to 10 atmospheres.

6. A process according to claim 1 wherein said hydrogenation catalyst is a metal.

7. A process according to claim 6 wherein said metal is nickel.

8. A process according to claim 7 wherein said nickel is present in a concentration of from 0.01 to 2% by weight, based on the quantity of said product to be treated.

9. A process for the simultaneous hydrogenation and deodorisation of at least one product selected from the group consisting of fats and oils, wherein said product is contacted countercurrently with carbon dioxide containing hydrogen to the extent of a hydrogen partial pressure of 1 to 10 atmospheres, at a temperature of from 100° to 250°C and a pressure of from 150 to 300 atmospheres in the presence of from 0.01 to 2% by weight of nickel.

10. A fat hydrogenated and deodorised by a process according to claim 1.

11. A fat hydrogenated and deodorised by a process according to claim 9.

12. An oil hydrogenated and deodorised by a process according to claim 1.

13. An oil hydrogenated and deodorised by a process according to claim 9.

14. Process according to claim 1, wherein the temperature is 190°–210°C.

15. Process according to claim 1, wherein the fats and oils are of vegetable and animal origin.

16. Process according to claim 1, wherein said product is ground not oil.

17. Process according to claim 1, wherein said product is sunflower oil.

18. Process according to claim 1, wherein said product is whale oil.

19. Process according to claim 1, wherein said product is fish oil.

20. Process according to claim 1, wherein said product is cottonseed oil.

21. Process according to claim 1, wherein said product is rape oil.

22. Process according to claim 1, wherein said product is soya oil.

* * * * *